United States Patent [19]

Misawa et al.

[11] 4,377,277

[45] Mar. 22, 1983

[54] BLAST FURNACE HAVING A COOLING DEVICE

[75] Inventors: Junzi Misawa; Shinjiro Wakuri; Kuniyoshi Anan, all of Ohita, Japan

[73] Assignee: Nippon Steel Corporation, Tokyo, Japan

[21] Appl. No.: 174,445

[22] Filed: Aug. 1, 1980

[30] Foreign Application Priority Data

Aug. 3, 1979 [JP] Japan ..... 54-98644
May 21, 1980 [JP] Japan ..... 55-67428

[51] Int. Cl.[3] ..... C21B 7/10

[52] U.S. Cl. ..... 266/80; 266/46; 266/87; 266/193

[58] Field of Search ..... 266/80, 87, 197, 193, 266/46

[56] References Cited

U.S. PATENT DOCUMENTS 2,915,305 12/1959 Craig ..... 73/86
3,820,770 6/1974 Snow ..... 266/193
4,061,317 12/1977 Andonier et al. ..... 266/193
4,157,815 6/1979 Saviski et al. ..... 266/193
4,238,118 12/1980 Czosnyka et al. ..... 266/46

FOREIGN PATENT DOCUMENTS 7224218 2/1974 France .
54-158306 12/1979 Japan .

OTHER PUBLICATIONS

*Iron and Steel Engineer*, vol. 53, No. 11, Nov. 1976, pp. 48–59.

*Primary Examiner*—M. J. Andrews
*Attorney, Agent, or Firm*—Cushman, Darby & Cushman

[57] ABSTRACT

A blast furnace having a cooling device between its hearth bottom and its foundation. The cooling device includes top and bottom groups of cooling fluid passages with a heat-insulating layer disposed therebetween, the top and bottom groups having independently regulable cooling capacities. Also provided is a method for operating a blast furnace including the steps of measuring a temperature in the hearth bottom, and controlling the cooling of the hearth bottom so that the specification point of the molten product in the hearth bottom maintains a predetermined level.

13 Claims, 9 Drawing Figures

| REFERENCL NUMERAL | THERMAL CONDUCTIVITY (Kcal/m·c·hr) | THICKNESS (m) |
|---|---|---|
| 22 | $\lambda_5$ | $\ell_5$ |
| 21 | $\lambda_4$ | $\ell_4$ |
| 20 | $\lambda_3$ | $\ell_3$ |
| 18 | | |
| 17 | $\lambda_2$ | $\ell_2$ |
| 16 | $\lambda_1$ | $\ell_1$ |

BLAST FURNACE HAVING A COOLING DEVICE

BACKGROUND OF THE INVENTION

This invention relates generally to blast furnaces and to their operation. More specifically the invention relates to the structure of the hearth bottom of a blast furnace and to a method for operating a blast furnace that protects the hearth bottom and provides enhanced flexibility to the operation of a blast furnace.

The hearth of a conventional blast furnace is usually made of refractory material, which, in the course of use, grows increasingly thinner as a result of chemical attack from the molten iron and slag thereon and as a result of thermal wear from the intense blast furnace heat.

There is normally provided on the bottom of the hearth a steel plate (hereinafter referred to as the "bottom plate") to keep the furnace well sealed. As the refractory material thins the thermal load on the bottom plate increases and it may become thermally deformed or worn off, thereby rendering normal blast furnace operation impossible.

Even if such thermal deformation or wearing of the bottom plate is avoided, a concrete foundation supporting the furnace structure may become heated and weakened, resulting in the deformation, or even breakdown, of the furnace structure. Such deformation or breakdown of a concrete foundation would also render the maintaining or continuing of normal furnace operation impossible.

Various arrangements for preserving the hearth bottom have been proposed. Such arrangements have included cooling the hearth bottom by providing a set of cooling fluid passages (hereinafter referred to as a cooling pipe) between the hearth bottom and the concrete foundation and regulating the quantity and/or type of cooling fluid supplied therethrough, or supplying different coolants, according to the thermal load working on the hearth bottom. Such an arrangement is disclosed in Japanese Patent Publications No. 10683 (1965) and No. 810801 (1976), and Japanese Patent Application Publication No. 74908 (1976).

The cooling arrangement such as those described in the above-mentioned references is not effective enough to provide adequate cooling to the hearth bottom because the amount of cooling cannot be adequately controlled. The flow rate of the cooling fluid (such as a mixture of water and air) cannot be increased freely with increasing thermal load on the hearth bottom because of the limit of the cooling pipe diameter or because of the capacity of the coolant supply unit providing the coolant.

Conventional cooling arrangements may include packing material, having good thermal conductivity packed around the cooling pipes to promote cooling. When the thermal load on the hearth bottom decreases, the cooling effect is lowered by changing the cooling fluid or reducing the fluid supply accordingly. However, when the hearth is not cooled, heat from inside the blast furnace is conducted through the packing material to the concrete foundation. This heats and weakens the concrete foundation, possibly leading to deformation or breakdown of the blast furnace structure.

As the size of the blast furnace change with a changing steel industry, greater flexibility in hearth bottom cooling arrangements are required. A conventional steelworks used to operate five to six mediumsized blast furnaces, each having a working volume of approximately 2000 $m^3$. With a more economical and efficient mass production in view, it has recently become a common practice to operate two or three 4000 $m^3$ or larger blast furnaces capable of producing more than 10,000 tons of pig iron per day. With the steel industry getting used to this new practice, the larger blast furnaces have proved effective in establishing stable low-cost iron production, lowering the fuel ratio from 500 kg to 400 kg per ton of pig iron produced.

However, unavoidable shutdowns of such a large blast furnace necessitates production increases in the remaining blast furnaces. On the other hand, when the industry faces a contraction of demand for steel, production must be curtailed sharply over a long period of time. Under such circumstances, a steelworks operating two or three extra-large blast furnaces has to make as great a production increase or decrease as is comparable to the production capacity of a conventional medium-sized blast furnace.

Generally, however, a blast furnace is designed to have a hearth bottom cooling capacity that is based on the thermal load working on the hearth refractory when the furnace is producing pig iron at full capacity. In addition to being designed for maximum load, the flexibility of the cooling capacity, particularly in the lower range, usually is very limited.

When fuel consumption is reduced to meet a sharp production cut as mentioned before, therefore, the hearth bottom is overcooled so that there arises an abnormal solidification of the molten product at the upper surface of the hearth bottom and a resulting bulging thereof. This leads to unstable production reduction and inefficient furnace operation. Thus, there is a need for a cooling arrangement providing sufficient flexibility to deal with a wide range of production level.

SUMMARY OF THE INVENTION

There is therefore provided a blast furnace arrangement and method of operation intended to overcome the above-described problems associated with conventional blast furnaces and their conventional operating methods.

An object of the present invention to provide a blast furnace including a cooling device having a wide range of cooling capacity so as to be able to provide proper cooling for a wide range of production levels.

Another object of the present invention is to provide a blast furnace and an operating method thereof that prevents the deterioration of the blast furnace foundation by maintaining an optimum cooling condition for the hearth bottom and foundation in accordance with the operating condition of the blast furnace.

Yet another object of the present invention is to provide a blast furnace and an operating method thereof that provides greater protection to the hearth bottom and greater flexibility to the furnace productivity by controlling the hearth bottom cooling capacity according to varying thermal load thereby controlling the level of the solid-liquid interface of the molten product.

In accordance with these objects, there is provided by the present invention, a blast furnace arrangement for controlling the cooling capacity of the hearth bottom as a function of varying thermal load and for adjusting the level of the solidifying point (hereinafter referred to as the level of solid-liquid interface) of the molten product within the furnace. The arrangement includes a cooling device having top and bottom groups of cooling fluid passages, each capable of independent adjustment of its cooling capacity, provided between the hearth bottom and the furnace foundation and a heat-insulating layer interposed between the two passages so as to prevent thermal interference between the two groups.

There is further provided a method for operating a blast furnace including the steps of measuring the temperature in the hearth bottom and controlling the cooling of the hearth bottom refractory according to the measured temperature so that the level of the solid-liquid interface will be such that the deposit formed on the upper surface of the hearth bottom refractory will have a desired thickness or shape.

Even under conditions of great thermal load imposed on the hearth bottom during a campaign of 6 to 10 years, the heat-insulating layer and independently adjustable top and bottom cooling pipe groups, provided between the hearth bottom and concrete foundation according to this invention, can independently control the temperature of the hearth bottom and the concrete foundation.

BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

DETAILED DESCRIPTION OF THE PREFERRED EMBODIMENTS

Figure 1:
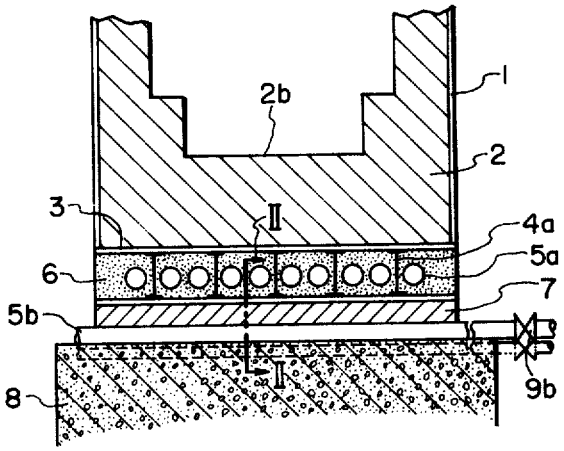
FIG. 1 is a sectional side view of a blast furnace hearth bottom according to a first embodiment of the present invention.
Figure 2:
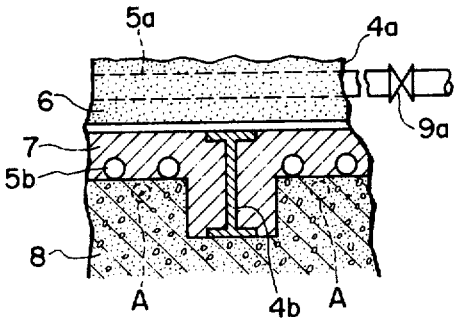
FIG. 2 is a cross-sectional view taken along the line II—II of FIG. 1.

Referring now to the drawings, wherein like reference numerals refer to like or corresponding parts throughout the several views, FIGS. 1 and 2 are respectively, sectional side and cross-sectional views of a first embodiment of a blast furnace according to the present invention.

The blast furnace includes a hearth bottom 2 enclosed by a steel shell 1 and having a bottom plate 3 at the bottom thereof. A concrete foundation 8 supports the furnace. A cooling device is placed between bottom plate 3 and concrete foundation 8. This cooling device includes three layers. The upper layer includes a number of cooling pipes 5*a* packed with a heat conductive packing material 6. Heat conductive packing material 6 has a heat conductivity of not less than four (4) kcal/m.hr.°C. such as SiC-C, MgO-C, $Al_2O_3$-C and other carbon-base castables or mortar.

The middle layer of the cooling device is a heat-insulating layer 7 providing a barrier to heat flow between the upper and lower layers. The lower layer includes a number of cooling pipes 5*b* laid over the top surface of the concrete foundation 8. Cooling pipes 5*a* cool the bottom of the hearth, while cooling pipes 5*b* cool concrete foundation 8. Cooling pipes 5*a* and 5*b* are perpendicularly disposed with respect to one another, with heat-insulating layer 7 therebetween to prevent heat flow between pipes 5*a* and 5*b*.

As a specific example, cooling pipes 5*a* may comprise 80 steel pipes each having a nominal diameter of 25 mm. This arrangement permits the use of feed headers 32*a* and 32*c* (see FIG. 5), drain headers 32*b* and 32*d* (see FIG. 5), and valves 9*a* and 9*b* (see FIG. 5) for the independent flow control of cooling pipes 5*a* and 5*b* respectively offering a great advantage to furnace layout. As will be more fully described later, this arrangement allows the control of the cooling capacity by changing either the type of cooling fluid and/or the flow rate of cooling fluid running through cooling pipe 5*a* in accordance with a change in the thermal load working on hearth bottom 2. Even if I-beams 4*a* and 4*b*, as shown in FIG. 2, are provided between cooling pipes 5*a* and 5*b*, the heat transmitted downward therethrough is intercepted by the heat-insulating layer 7, inhibiting a rise in the temperature of concrete foundation 8.

In the embodiment shown in FIGS. 1 and 2, cooling fluid is passed separately through the cooling pipes 5*a* and 5*b*. The type of cooling fluid, the varying of its flow rate, and the control of its temperature for each pipe group can be accomplished separately and independently of the other. This permits maintaining concrete foundation 8 at any desired temperature, i.e., below the control temperature of the blast furnace, thereby preventing deterioration of the concrete due to excessive heat.

Therefore, when the thermal load working on hearth bottom 2 is low, the cooling capacity of cooling pipes 5*a* can be lowered by reducing the coolant flow rate therein by adjusting the opening of valve 9*a* accordingly. Even when the cooling capacity of cooling pipes 5*a* is further lowered to zero, concrete foundation 8 is prevented from deteriorating by being kept insulated from the heat of the blast furnace by heat-insulating layer 7 and by being held below the control temperature by the cooling fluid flow in cooling pipes 5*b*. Heat-insulating layer 7 maintains the cooling effect of cooling pipes 5*a* isolated from the cooling effect of cooling pipes 5*b*. Adiabatic castable refractories, adiabatic mortar, cement mortar, concrete and air having a heat conductivity of not higher than 2 kcal/m.hr.°C. are among the materials suitable for use as heat-insulating layer 7, because they (1) permit reducing the thickness of the heat-insulating layer to a minimum, and (2) require a minimum modification of the hearth bottom structure of a conventional blast furnace. High compressive strength and low cost make cement mortar most favorable of all of the above-mentioned materials. Of course, other materials having sufficient insulating properties may be substituted.

The thickness of heat-insulating layer 7 depends upon the heat-conductivity of the material thereof. For example, when a 4000 $m^3$ blast furnace having bottom plate 3 is heated to approximately 250° C., approximately 80 mm thickness is sufficient for cement mortar having a heat conductivity of 1 kcal/m.hr.°C. Providing a coolant flow meter (not shown) for each cooling pipe 5a facilitates flow rate control as a function of thermal load. Providing a coolant cooling device facilitates control of the cooling capacity (the amount of heat removed) from hearth bottom 2, through a combination of flow rate and temperature control.

It is preferable that the quantity of the cooling fluid running through cooling pipes 5b be controlled by adjusting the opening of valve 9b so that the temperature of concrete foundation 8, which is measured appropriately, be kept within predetermined control limits at all times, i.e. not higher than 80° C. during normal operation and not higher than 100° C. during an emergency. When the temperature of concrete foundation 8 drops below the predetermined control limit, the flow rate may be held at a fixed level, without adjusting the opening of valve 9b from time to time, through such a procedure entails some uneconomical excess supply of the coolant.

Cooling pipes 5b, which are laid over the top surface of the concrete foundation 8 in the above-described embodiment, may also be provided in the concrete foundation 8 as indicated dotted line A shown in FIG. 2.

Cooling pipes 5a and 5b may be disposed parallel with each other instead of perpendicular. In the parallel arrangement, a localized rise in the concrete temperature which might result from a localized extensive cooling capacity adjustment of cooling pipes 5a can effectively be prevented by adjusting the cooling capacity of cooling pipes 5b in the region in question.

Figure 3:
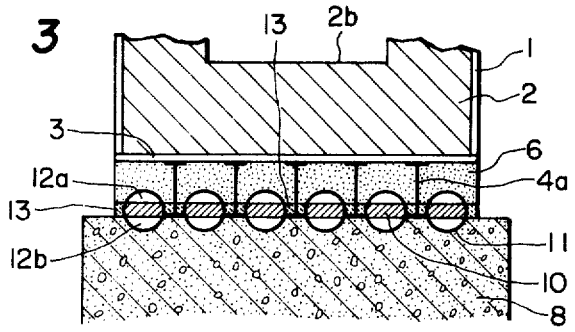
FIG. 3 is a sectional side view of a second embodiment of a blast furnace hearth bottom according to the present invention.

Referring now to FIG. 3, there is shown a sectional side view of a second embodiment of the blast furnace arrangement according to the present invention. A heat-insulating layer 10 having a heat conductivity of not greater than 2 kcal/m.hr.°C. bisects a cross section of a cooling pipes 11 in the middle thereof to form upper and lower coolant passages 12a and 12b, respectively. A heat-insulating layer 13, having a heat conductivity of not greater than 2 kcal/m.hr.°C., is provided between adjacent cooling pipes 11 at the same level as the heat-insulating layer 10 in cooling pipes 11. Upper coolant passages 12a of the cooling pipes 11 are buried in packing material 6, while lower coolant passages 12b are in concrete foundation 8. As in the first embodiment, shown in FIGS. 1 and 2 this second embodiment also separately cools hearth bottom 3 and concrete foundation 8 with appropriate cooling capacities, individually changing the kind and/or flow rate of the cooling fluids running through the two coolant passages 12a and 12b.

Experiments conducted on the operation of a blast furnace having the above-described hearth bottom structure have shown the following:

(1) A conventional medium-sized blast furnace has a diameter of approximately 10 m, with a distance between the tuyeres and the top surface of the hearth bottom refractory ranging from 4 to 5 m. A modern larger blast furnace is not less than 1.5 times larger, with the furnace diameter ranging from 13 to 15 m and the tuyere-hearth bottom distance from 6 to 8 m. Nevertheless, the size of the high-temperature raceway in front of the tuyeres remains substantially unchanged. In the larger blast furnaces, therefore, heat transfer from before the tuyeres to the hearth bottom refractory is difficult, especially in the middle of the top surface thereof.

(2) As mentioned previously, a modern larger blast furnace has to undergo a greater production increase or decrease than a conventional medium-sized one, with an ensuing increase in the fluctuations in the thermal load working on the hearth bottom refractory.

(3) Such extensive thermal load fluctuations make it difficult to keep the hearth bottom in good condition by using the conventional cooling method. If furnace fuel consumption is reduced to control pig iron production, the temperature in the middle of the hearth bottom refractory drops before the temperature of the outer regions of the hearth bottom. This results in the molten product beginning to solidify to form a deposit on the surface thereof.

(4) In the lower part of the hearth, consequently, the molten product is forced to pass through a limited area near the hearth walls, which, in turn, furthers the temperature drop further increasing the deposit growth in the middle. If the deposit spreads as far as into the peripheral molten product passage left unfilled, iron and slag withdrawing operations are seriously hampered.

(5) Controlling the deposit thickness on the hearth bottom refractory within a given limit prevents the erosion of the refractory, permits continuing smooth withdrawal of iron and slag, and insures a highly stable operation.

Figure 4:
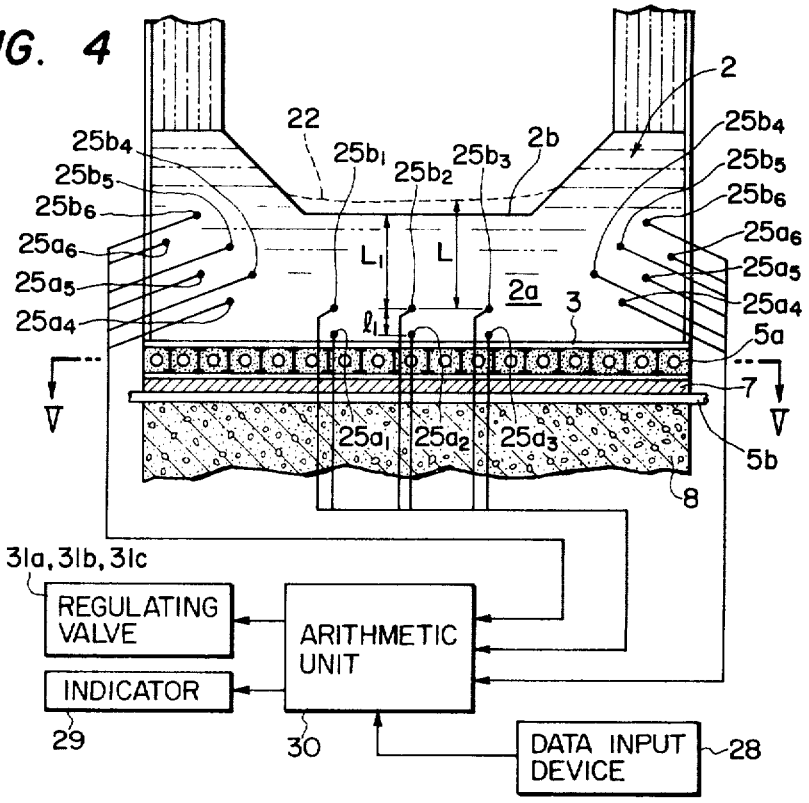
FIG. 4 is a cross-sectional view of a blast furnace hearth bottom for implementing an operating method according to the present invention.
Figure 5:
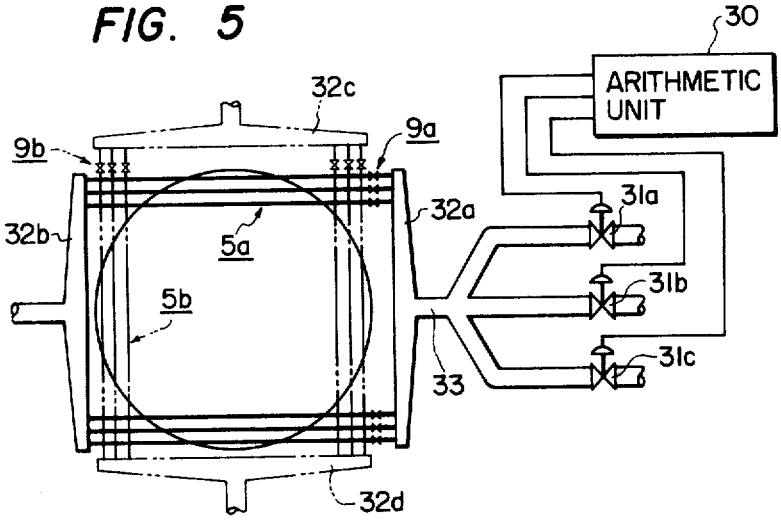
FIG. 5 is a schematic plan view taken along the line V—V of FIG. 4, showing a coolant pipe system for cooling a hearth bottom.

A blast furnace operating method according to this invention is based on the above findings, which will be described in detail by reference to FIGS. 4 and 5 which are cross-sectional and schematic plan views, respectively, showing a blast furnace having a working volume of 4000 $m^3$, a tapping capacity of 10,000 tons per day, a 4.5 m thick hearth bottom refractory, and showing equipment for implementing the operating method of this invention. The cooling pipes and other similar parts are designated by like reference numerals to those used in other figures.

Reference numerals $25a_1$ to $25a_6$ and $25b_1$ to $25b_6$ designate thermocouples for measuring temperature. Thermocouples $25a_1$ through $25a_3$ are installed in refractory 2a immediately above hearth bottom plate 3, and thermocouples $25b_1$ through $26b_3$ are installed 650 mm thereabove. Three each, for a total of nine, of thermocouples $25a_1$ to $25a_3$ and $25b_1$ to $25b_3$ are disposed at predetermined intervals in the horizontal planes within the hearth bottom refractory 2a. Twenty each, for a total of sixty, of thermocouples $25a_4$ to $25a_6$ and $25b_4$ to $25b_6$ are disposed at predetermined intervals in regions closer to the periphery of hearth bottom 2. Thermocouples $25a_4$ to $25a_6$ and $25b_4$ to $25b_6$ are buried in refractory 2a so that the individual groups are separated from each other at 100–200 mm intervals. Reference numeral 28 designates a data input device, 29 an indicator, 30 an arithmetic unit, 31a, 31b and 31c by-coolant flow rate regulating valves, 9a a by-system flow rate regulating valve, and 33 a coolant supply pipe. As the blast furnace starts operation, temperature $T_1$, measured by thermocouples $25a_1$ to $25a_6$, and temperature $T_2$, measured by the thermocouples $25b_1$ to $25b_6$ are introduced into arithmetic unit 30.

Previously stored in arithmetic unit 30 are the heat conductivity value, $\lambda_1$ of the refractory between thermocouples $25a_1$ to $25a_6$ and $25b_1$ to $25b_6$, distance $L_1$ between the top surface 2b of the refractory and the thermocouples $26b_1$ to $25b_6$, distance $l_1$ between the thermocouples $25a_1$ to $25a_6$ and $25b_1$ to $25b_6$, temperature Ta at solid-liquid interfaces, and distance Lo (hereinafter referred to as the desired level Lo) between thermocouples $25b_1$ to $25b_6$ and a given solid-liquid interface. These data are introduced by the user through data input device 28. The solid-liquid interface defines a horizontal plane where the surface of a deposit 22 formed on the top surface 2b of the hearth bottom refractory 2a and the bottom of the molten iron meet (when no deposit exists, the solid-liquid interface is the top surface 2b of the hearth bottom refractory).

Using the measured temperatures and values, arithmetic unit 30 computes the amount of heat load $Q_1$ passing through the hearth bottom refractory between thermocouples $25a_1$ to $25a_6$ and $25b_1$ to $25b_6$ and the distance L between the thermocouples $25b_1$ to $25b_6$ and the solid-liquid interface (hereinafter called the solid-liquid interface level), based on the following pre-stored equations (1) and (2).

$$Q_1=\lambda_1(\Delta T/l_1) \quad (\text{kcal/m}^2.\text{hr}) \tag{1}$$

where $\lambda_1$=heat conductivity of the refractory brick between thermocouples $25a_1$ to $25a_6$ and $25b_1$ to $25b_6$ (kcal/m.hr.°C.)

$l_1$=vertical distance between the thermocouples $25a_1$ to $25a_6$ and $25b_1$ to $25b_6$ (m), and $\Delta T=T_2-T_1$ (°C.); and $$L=(\lambda/Q_1)(T_a-T_2) \quad (\text{m}) \tag{2}$$

where $\lambda$=mean heat conductivity (kcal/m.hr.°C.)

Assuming that the hearth bottom refractory and the deposit formed thereon have heat conductivities $\lambda_1$, $\lambda_2$, . . . $\lambda_{n-1}$, and $\lambda_n$ and thicknesses $l_1$, $l_2$ . . . $l_{n-1}$, and $l_n$ then $\lambda$ is expressed as follows:

$$\lambda = \frac{l_1 + l_2 + \ldots + l_{n-1} + l_n}{l_1/\lambda_1 + l_2/\lambda_2 \ldots l_{n-1}/\lambda_{n-1} + l_n/\lambda_n}$$

where $l_i/\lambda_i$=resistance to heat transfer

These relationships take into account the solid-liquid interface levels at a total of 69 points and are computed for each of plural sampling times. When the solid-liquid interface level L differs from the desired level Lo, the actual level L is adjusted to desired level Lo by controlling the opening of by-coolant flow rate regulating valves 31a, 31b and 31c, using a pre-stored cooling capacity adjusting pattern illustrated in FIG. 6.

Figure 6:
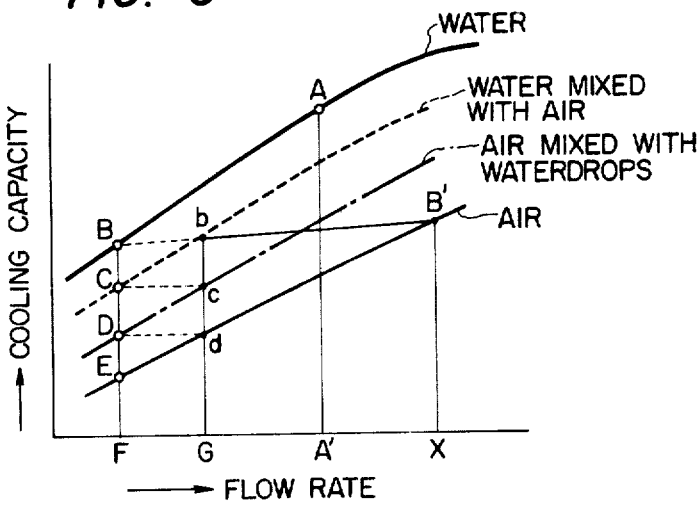
FIG. 6 graphically illustrates the relationship between the coolant flow rate and the cooling capacity along with the operating trend in an embodiment of this invention.

Referring now to FIG. 6, there is graphically shown the relationship between coolant flow rate and cooling capacity. As mentioned previously, the cooling capacity must be adjusted on both the plus side and the minus side. Using the full range of the adjusting pattern shown in FIG. 6, the cooling capacity is decreased at one time and increased at another. Basically, the capacity is decreased according to the following procedure, which is reversed in the case of increased capacity.

To begin with, the cooling capacity is lowered from A to B by gradually decreasing the water flow rate from A' to F. Then, the coolant is changed from water to air, which is supplied at a flow rate of x to attain a cooling capacity B' that is equivalent to B. By then reducing the air flow rate from x through A' and G to F, the cooling capacity is gradually lowered to E. Namely, it is possible to attain without a discontinuity, and maintain, a desired cooling capacity from A and E.

When restrictive peripheral conditions, such as the size and capacity (difficulty in attaining the flow rate x, for example) of the cooling device exist, air bubbles may be mixed in water to form a double-layer fluid, which is supplied at a flow rate G to attain a cooling capacity b. Then the flow rate is reduced to F to lower the cooling capacity to C. Air is increased to make a misty fluid, which is supplied at a flow rate G with a cooling capacity c, then at a flow rate F with a reduced cooling capacity D. Then water supply is cut to leave air alone, which is supplied at a flow rate G to build up a cooling capacity d, then at a flow rate F with a lowered cooling capacity E. The cooling capacity is thus controlled according to the peripheral conditions by introducing various combinations on the basis of the above-described concept.

Figure 7:
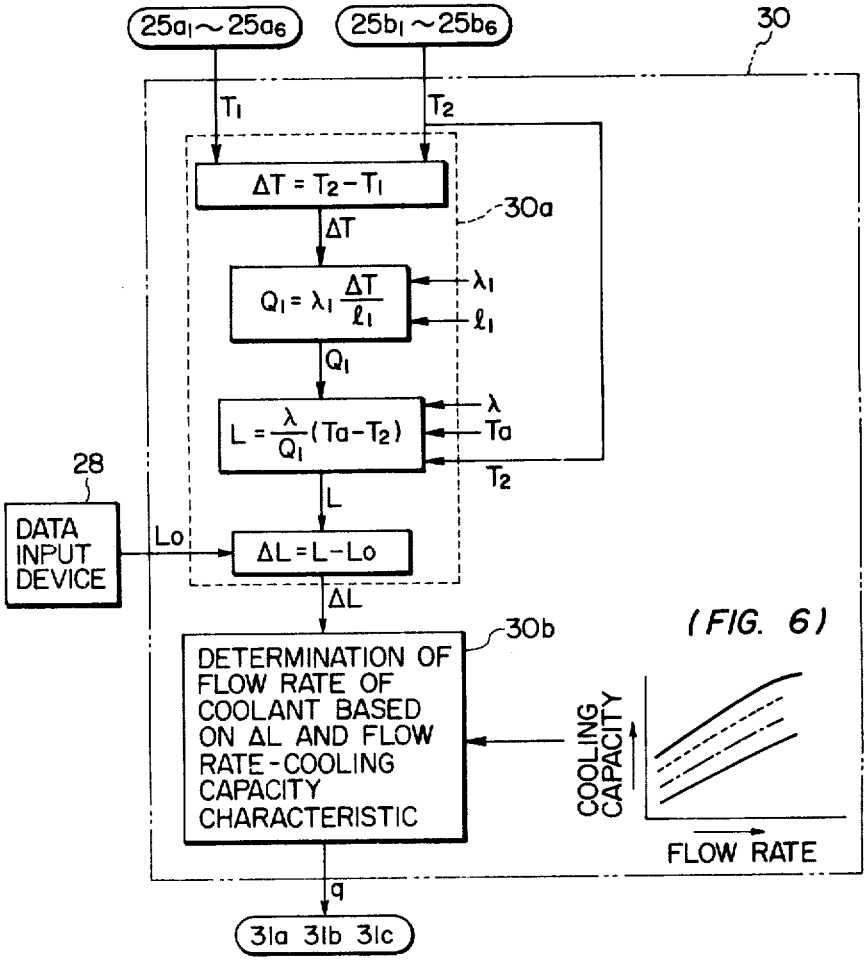
FIG. 7 is a flow chart showing operating procedures followed by an arithmetic unit in the control of the solid-liquid interface level.

Referring now to FIG. 7, there is shown a flow chart describing the computation processes followed by the arithmetic unit 30 for controlling the cooling of the hearth bottom and thereby controlling the solid-liquid interface level. A computing section 30a determines a difference $\Delta T$ between the temperatures $T_2$ (from the thermocouples $25b_1$ to $25b_6$) and $T_1$ (from the thermocouples $25a_1$ to $25a_6$) which have been inputted to arithmetic unit 30. Then the heat load $Q_1$ (at the hearth bottom) and the distance L (between the thermocouples $25b_1$ to $25b_6$ and the top surface of the deposit) are computed from the temperature difference $\Delta T$. A difference from the distance L, computed, and the desired level Lo entered by the user through data input device 28 is determined, and inputted to a control instruction section 30b as an operation signal $\Delta L$. Control instruction section 30b determines an appropriate flow rate of coolant to be supplied to the cooling pipes 5a based on the signal $\Delta L$ and the flow rate-cooling capacity characteristic. The obtained result is outputted the flow rate regulating valves 31a, 31b and 31c as an operating amount q. Difference adjustment at 69 measuring points is performed by the by-system flow rate regulating valve 9a.

In implementing this invention, the equations stored in the arithmetic unit 30 are not limited to those described before. Further, operation is not limited to full automatic control with the use of an automatic arithmetic unit, but also may be effected manually with substantially the same effect except the need for operator decision making and control.

There will now be described with reference to FIG. 8 a specific example of a large blast furnace whose production was decreased without adverse effects by utilizing the blast furnace arrangement and method of operation according to the present invention. The blast furnace, in service for over 5 years, had its daily production rate decreased from 9000 tons to 7500 tons. This corresponded to a decrease in iron production or tapping rate by 17 percent. As production was cut, the temperature of the hearth bottom dropped sharply (with a slight time lag from the productuon cut).

Figure 8:
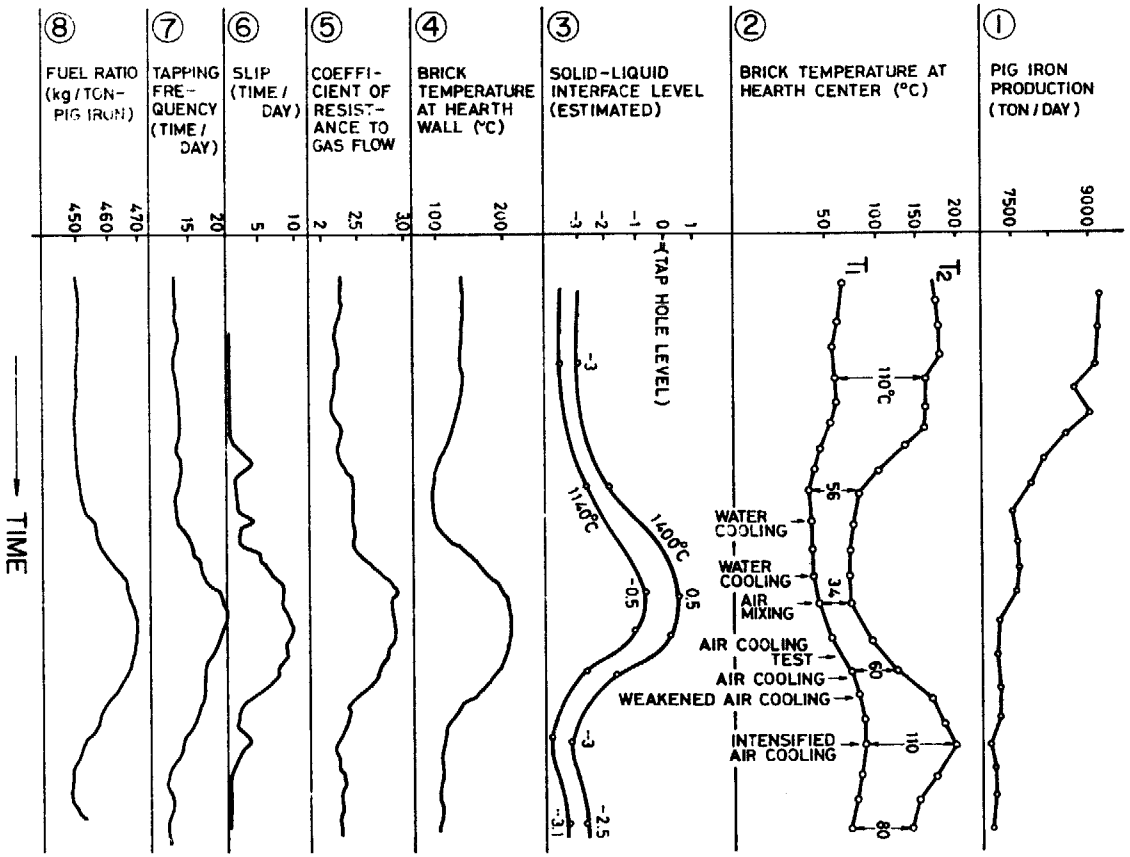
FIG. 8 graphically illustrates changes, as a function of time, in the following eight parameters observed during furnace operation according to this invention, (1) pig iron production, (2) brick temperature at hearth center, (3) level of solid-liquid interface, (4) brick temperature at hearth wall, (5) co-efficient of resistance to gas passage, (6) slip, (7) frequency of tapping, and (8) fuel ratio.

Referring now to FIG. 8, there are shown graphically the changes, as a function of time, of eight parameters observed during the operation of a blast furnace arrangement according to the present invention, operating in accordance with the method of the present invention. The eight parameters include: (1) pig iron production, (2) brick temperature at hearth center, (3) level of solid-liquid interface, (4) brick temperature at hearth wall, (5) coefficient of resistance to gas passage, (6) slip, (7) frequency of tapping, and (8) fuel ratio.

Specifically, changes in temperature of bricks in the middle of hearth bottom 3 are indicated. Temperature $T_2$ at point 25$b_2$, which is away from the bottom plate, dropped substantially from about 150° C. to below 100° C., normally coinciding with a rise of the solid-liquid interface within the furnace. Therefore the coolant flow rate for hearth bottom 3 was decreased gradually.

With the temperature drop of hearth bottom 3 slowed down but not stopped, the operating condition of the blast furnace grew worse as decribed later. Therefore, the cooling capacity adjusting pattern (shown in FIG. 6) was followed by decreasing the cooling water supply, mixing air to reduce water volume, increasing the air ratio to supply a misty coolant, supplying air alone, and decreasing the air supply in that order, resulting in a temperature curve as shown in (2) of FIG. 8.

Consequently, both temperatures $T_1$ and $T_2$ in hearth bottom 3 rose gradually, with furnace operation improved. As the temperature showed a tendency to become too high, the quantity of cooling air was increased to an appropriate level described later in order to protect the furnace from damage. This corrective measure permitted continuing a stable operation.

The above procedure will now be described in further detail with reference to the solid-liquid interface level shown in (3) of FIG. 8 and determined in accordance with the above equations and from the aforementioned temperature change.

The molten product in the blast furnace is divided into molten iron and slag which have different temperatures at solid-liquid interfaces. The melting point of iron varies between 1150° C. and 1100° C. depending on the contents of Si and other elements. Here, 1140° C. is used as a typical temperature.

The melting point of slag varies widely depending on its chemical composition. Here, 1400° C. is selected as a typical temperature that permits slag to flow freely away from molten metal. By reference to the tap hole level, the levels of the solid-liquid interfaces in the furnace center are indicated by a plus sign (+) on the furnace top side and a minus sign (−) on the furnace bottom side as shown in (3) of FIG. 8. Estimation was made by a 2-point temperature measuring method, using an equation described later. Heat conductivity varies with the refractory brick size and material, deposits formed in the furnace, and other factors, and this variation was taken into consideration.

For clarity of illustration, this example shows only typical values in the middle of the hearth bottom. Using more lines and planes, including the hearth walls, makes the estimation more complex but more accurate.

As seen, the solid-liquid interface in the hearth rose with decreasing production rates. In extreme cases, the 1400° C. level in the furnace center rose above the tap hole leve, with the 1140° C. level within 1 m below the tap hole level. The series of corrective actions taken returned the solid-liquid interfaces to the original normal levels before the production cut, clearly showing the effect of this invention.

The foregoing and other analytical results indicate that it is highly preferably from the viewpoint of operation and maintenance that the 1400° C. level be held within the +0.5 m to −3.5 m range and the 1140° C. level within the −0.5 m to −4 m range with respect to the tap hole level. In this connection, it is preferable for the assurance of lining protection and stable tapping slag removal that the 1140° C. level lies above the top surface 2*b* of the hearth bottom refractory 2*a* and close to inside bottom of the furnace.

Because slag floats on the top of molten iron, the solid-liquid interface level of the latter is used for the control of the cooling capacity. But it is also possible to use the solid-liquid interface of both or that of the former.

Figure 9:
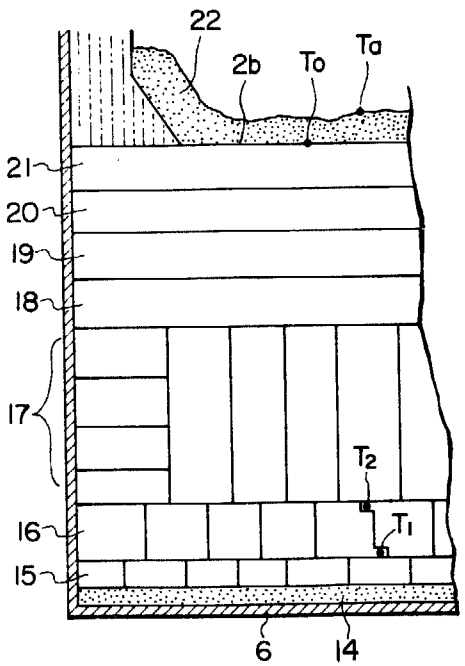
FIG. 9 is a partial cross-sectional view of a hearth bottom showing the thickness and thermal conductivity of each refractory brick and a brickwork structure.

The method of estimating the solid-liquid interface level is based upon equations (1) for the heat load on the hearth bottom refractory and equation (2) for the level of the solid-liquid interface stored in the arithmetic unit 3, with consideration given to the type of refractory making up the hearth bottom, as described hereunder by reference to FIG. 9.

Referring now to FIG. 9, there is shown a partial cross-sectional view of a hearth bottom showing the thickness and thermal conductivity of each refractory brick and brickwork structure. In FIG. 9, reference numeral 14 designates mortar, 15 a first-layer brick, 16 a second-layer brick, 17 a vertically laid brick section, 18 a third-layer brick, 19 a fourth-layer brick, 20 a fifth-layer brick, 21 an uppermost brick, and 22 a deposit formed on the hearth bottom. The following computation is made based on the temperatures detected by the buried measuring elements. Symbols similar to those used in equations (1) and (2) are not specifically defined here.

If $T_1$ and $T_2$ are know, heat load $Q_1$ passing through the second-layer brick 16 is expressed as $$Q_1 = \frac{\lambda_1(T_2 - T_1)}{l_1} \tag{3}$$

If $T_0$, the temperature at the top surface of the uppermost hearth bottom brick, and $T_2$ are known, the same $Q_1$ is derived from the following equation:

$$Q_1 = \frac{(T_0 - T_2)}{\left(\frac{l_2}{\lambda_2} + \frac{l_3}{\lambda_3} + \frac{l_4}{\lambda_4}\right)} \tag{4}$$

$T_0$, which cannot be actually measured actually, can be determined as follows:

$$T_0 = Q_1\left(\frac{l_2}{\lambda_2} + \frac{l_3}{\lambda_3} + \frac{l_4}{\lambda_4}\right) + T_2 \tag{5}$$

$$= Q_1\left(\frac{l_1}{\lambda_1} + \frac{l_2}{\lambda_2} + \frac{l_3}{\lambda_3} + \frac{l_4}{\lambda_4}\right) + T_1$$

Rearranging the relationship among equations (3) and (4) and Ta, $$Q_1 = \frac{(T_a - T_2)}{\left(\frac{l_2}{\lambda_2} + \frac{l_3}{\lambda_3} + \frac{l_4}{\lambda_4} + \frac{l_5}{\lambda_5}\right)} \tag{6}$$

where $l_5$ = thickness of deposit at the hearth bottom (m)

By expanding equation (6), $l_5$ is determined as follows:

$$l_5 = \left\{ \left( \frac{T_a - T_2}{Q_1} \right) - \left( \frac{l_2}{\lambda_2} + \frac{l_3}{\lambda_3} + \frac{l_4}{\lambda_4} \right) \right\} \lambda_5 \quad (7)$$

From $l_5$ thus determined and $l_2$, $l_3$ and $l_4$ previously established, L is determined as follows:

$$L = l_2 + l_3 + l_4 + l_5 \quad (8)$$

Here, $T_2$ is expressed as follows:

$$T_2 = \frac{Q_1 l_1}{\lambda_1} + T_1 \quad (9)$$

The change in mean hearth wall temperature is shown in FIG. 8 (4). The mean hearth wall temperature averages from the circularly distributed 60 measurements taken at the surface of bricks laid approximately 1.5 m below the tap hole level. As seen, the mean hearth wall temperature (4) first drops, parallel with the hearth bottom temperature, as the tapping rate decreases. But it rises sharply halfway, following the aforesaid rise of the solid-liquid interface level, with a slight time lag. This phenomenon can be explained as follows: During the first stage, the hearth temperature on the average drops with the decrease in fuel consumption per unit time in the blast furnace necessitated by the lowering of production rate. The subsequent sharp upturn of the hearth temperature is due to the rising solid-liquid interface level in the furnace center. As the solidified deposit, which prevents the flow of the molten products, increases its height, molten iron and slag flow increasingly toward the peripheral area close to the tuyeres at high temperatures. These molten products wash the deposit off the surface of the wall bricks, thus raising the temperature thereat. But the corrective measures bring the hearth wall temperature back to the original level. Generally, increase in the hearth wall temperature is accompanied by the thinning, or wearing off, of bricks, which might lead to a hearth breaking. So control of the hearth wall temperature is an important furnace maintenance point.

It is therefore essential that the solid-liquid interface level in the hearth bottom be held at least below the aforesaid limit, as effectively achieved by the operating method of this invention.

FIG. 8 graphically illustrates operating trends in various furnace operation parameters at (5), (6), (7) and (8), by reference to the series of corrective actions taken. Coefficient of resistance to gas flow (5), slip (6), tapping frequency (7) and fuel ratio (8) are well-known parameters indicating the operating condition and performance of a blast furnace, all of them indicating an unfavorable condition when increased. Evidently, these parameters change in inverse proportion to the hearth bottom temperature, and in proportion to the level of the solid-liquid interface in the furnace center.

Coefficient of resistance to gas flow shown in FIG. 8 (5) is expressed as $(B_p^2 - T_p^2)/V_G^{1.7}$ (where $B_p$=blast pressure, gr/cm$^2$, $T_p$=top pressure, gr/cm$^2$, and $V_G$=quantity of bosh gas arising in front of tuyeres, Nm$^3$/min.). Maintenance of this permeability is very important for the operation of the blast furnace which is, in essence, a type of packed reaction tower. The blast furnace under consideration functioned satisfactorily when the coefficient was held within the 2.2 to 2.6 range. This trend is absolutely the same as the behavior or the solid-liquid interface level in the hearth bottom.

Slip shown in FIG. 8 (6) indicates the falling condition of the burden in the blast furnace detected by a sounding meter. When the furnace reaction is normal, the burden falls continuously at a constant create. When irregular, the falling rate varies. The slip represents an operating condition in which the burden drops more than 1 m at a discontinuous increased rate. Generally, this phenomenon occurs when the circular uniformity of furnace reaction is broken, powdery or readily pulverizable materials are charged, the molten products in the furnace bottom falls, or molten iron and slag are withdrawn unsatisfactorily.

In view of the consistency between the change in the solid-liquid interface level and the slip, the slip in the blast furnace under consideration seems to have resulted from the melt-down and irregular withdrawal of molten metal and slag.

Tapping frequency shown in FIG. 8 (7) refers to the number of openings and closings of the taphole and slag notch per day for the withdrawal of molten metal and slag. When the furnace reaction carries on smoothly and good fluidity is maintained, the molten products in the hearth are continuously withdrawn until the withdrawn products wear off the notch refractory to a critical limit. When the critical limit is reached, the iron and slag notches are plugged with packing material.

When a blast furnace produces approximately 9000 tons of pig iron per day without significant trouble, the daily tapping frequency is 12 to 13 times. With the blast furnace under consideration, the tapping frequency increased with rising solid-liquid interface level, reaching a peak of 20 times a day. But the operating method according to this invention lowered the tapping frequency to the normal level, along with the lowering of the solid-liquid interface level. When the solid-liquid interface level in the hearth rises, molten metal cannot flow to the tap hole freely. As a consequence, the withdrawal rate exceeds the rate at which molten metal flows to before the tap hole within the furnace when a certain quantity of molten metal has been withdrawn. This results in an ejection of furnace gas through the tap hole, instead of or together with molten metal. In this case, the tap hole must be plugged even if the refractory thereof is not yet seriously worn off. Since this leads to insufficient tapping and a possible slip, another tap hole must be opened, which results in increased tapping frequency per day.

Fuel ratio shown in FIG. 8 (8) shows the terminal efficiency of a blast furnace. The lower the fuel ratio, the higher the furnace efficiency. This is an important criterion showing the level of iron production cost. This value changes in inverse proportion to the thermal efficiency in the blast furnace, which, in turn, varies parallel with the degree of smoothness of the furnace reaction. Namely, the fuel ratio is an important comprehensive criterion for judging the operating condition of a blast furnace under fixed raw material and working conditions. As shown, the fuel ratio changes parallel with the solid-liquid inteface level with a slight time lag. This fact evidences the effectiveness and importance of the control of the solid-liquid interface level through the adjustment of the hearth bottom cooling capacity which constitutes a characteristic of this invention.

What is claimed is:

1. A blast furnace comprising:

a foundation;

a hearth bottom including a course of hearth bottom bricks;

a first group of cooling fluid passages horizontally disposed between said course of hearth bottom bricks and said blast furnace foundation for controlling the temperature of the hearth bottom;

a second group of cooling fluid passages horizontally disposed adjacent to or in the blast furnace foundation for directly controlling the temperature of the foundation;

a heat-insulating layer interposed between said first group and said second group of cooling fluid passages permitting said first and second groups of cooling passages to respectively control the temperatures of the hearth bottom and foundation independently; and a cooling fluid supply device connected to the first and second cooling fluid passage groups, said supply device supplying a cooling fluid to each of said groups of cooling fluid passages so that the cooling capacity of each group can be adjustable independently of the other.

2. A blast furnace according to claim 1, wherein the passages of said first and second groups are oriented at right angles to each other.

3. A blast furnace according to claim 1, wherein the passages of said first and second cooling fluid passage groups are oriented parallel to each other.

4. A blast furnace according to claim 1, 2 or 3 wherein said supply device includes means for either or both changing the kind and adjusting the flow rate of the cooling fluid passed through the passages of said first group of cooling fluid passages.

5. A blast furnace according to claim 1, 2 or 3, wherein the cooling fluid passed through said first group of cooling fluid passages is a member of the group consisting of: argon, nitrogen, air, steam and water.

6. In a blast furnace having a hearth bottom and a foundation, the improvement comprising:

a course of hearth bottom bricks;

a first group of cooling fluid passages horizontally disposed between said course of hearth bottom bricks and said foundation for controlling the temperature of the hearth bottom;

a second group of cooling fluid passages horizontally disposed adjacent to or in said foundation for directly controlling the temperature of the foundation;

a heat insulating layer interposed between said first group and said second group of cooling fluid passages permitting said first and second groups of cooling passages to respectively control the temperatures of the hearth bottom and foundation independently; and a cooling fluid supply device connected to the first and second cooling fluid passage groups, said supply device supplying a cooling fluid to each of said groups of cooling fluid passages so that the cooling capacity of each group can be adjusted independently of the other.

7. An improvement according to claim 6 wherein, the passage of said first and second groups are oriented at right angles to each other.

8. An improvement according to claim 6 wherein, the passages of said first and second cooling fluid passage groups are oriented parallel to each other.

9. An improvement according to claim 6, 7 or 8 wherein, said supply device includes means for either or both changing the kind and adjusting the flow rate of the cooling fluid passed through the passage of said first group of cooling fluid passages.

10. An improvement according to claims 6, 7 or 8, wherein the cooling fluid passed through said first group of cooling fluid passages is a member of the group consisting of: argon, nitrogen, air, steam and water.

11. A blast furnace, comprising:

a foundation;

a hearth bottom having hearth bottom bricks;

a first group of cooling fluid passages horizontally disposed between said hearth bottom bricks and said blast furnace foundation for controlling the temperature of the hearth bottom;

a second group of cooling fluid passages horizontally disposed adjacent to or in the blast furnace foundation for directly controlling the temperature of the foundation;

a heat-insulating layer interposed between said first group and said second group of cooling fluid passages permitting said first and second groups of cooling passages to respectively control the temperatures of the hearth bottom and foundation independently;

means for measuring the temperature inside the hearth bottom using a plurality of temperature measuring elements disposed therein;

means for computing, based upon the measured temperature, and the heat conductivity and thickness of the hearth bottom bricks, the thickness of any deposit that may have formed on the top surface of the hearth bottom; and means for either or both (a) changing the kind and (b) adjusting the flow rate of a cooling fluid passed through the cooling fluid passages so that the deposit does not exceed a predetermined thickness.

12. A blast furnace having a cooling apparatus for controlling the temperature of the furnace's hearth bottom and foundation comprising:

a foundation;

a hearth bottom;

a first group of cooling fluid passages horizontally disposed between said hearth bottom and said blast furnace foundation for controlling the temperature of the hearth bottom;

a second group of cooling fluid passages horizontally disposed adjacent to or in the blast furnace foundation for directly controlling the temperature of the foundation;

a heat insulating layer interposed between said first group and said second group of cooling fluid passages permitting said first and second groups of cooling passages to respectively control the temperatures of the hearth bottom and foundation independently;

means for measuring the temperature at a predetermined point within the hearth bottom;

means for computing, based upon the measured temperature and known parameters including the heat conductivity of the hearth and its thickness, the thickness of a deposit formed on the top surface of the hearth bottom;

means for comparing the thickness, so computed, with a predetermined desired maximum thickness, and means for controlling, via said cooling apparatus, the temperature of the furnace's hearth bottom so as to control the thickness of the deposit so that it does not exceed the predetermined maximum thickness.

13. A blast furnace according to claim 12 wherein said means for controlling includes means for either or both (a) changing the kind of and (b) adjusting the flow rate of a cooling fluid passed through a said cooling apparatus.

* * * * *